US006101902A

United States Patent [19]

Wei

[11] Patent Number: 6,101,902

[45] Date of Patent: Aug. 15, 2000

[54] RATCHET WRENCH

[76] Inventor: Hung Yin Wei, No.2, Lane 235, Yung-I Road, Tai-Ping City, Taichung Hsien, Taiwan

[21] Appl. No.: 09/235,388

[22] Filed: Jan. 22, 1999

[51] Int. Cl.[7] ..... B25B 13/46

[52] U.S. Cl. ..... 81/63; 81/59.1; 81/177.1

[58] Field of Search ..... 81/63, 60, 61, 81/62

[56] References Cited

U.S. PATENT DOCUMENTS

| | | | |
|---|---|---|---|
| 4,722,252 | 2/1988 | Fulcher et al. | 81/57.39 |
| 4,791,836 | 12/1988 | D'Haem et al. | 81/57.39 |
| 4,819,521 | 4/1989 | Lang | 81/63 |
| 5,119,701 | 6/1992 | Wei | 81/63 |
| 5,687,623 | 11/1997 | Hsieh | 81/60 |
| 5,848,561 | 12/1998 | Hsieh | 81/59.1 |
| 5,857,390 | 1/1999 | Whiteford | 81/62 |

*Primary Examiner*—David A. Scherbel
*Assistant Examiner*—Hadi Shakeri
*Attorney, Agent, or Firm*—Rosenberg, Klein & Lee

[57] ABSTRACT

A ratchet wrench including two clamping panels, a base seat, a rotary member, an engaging member, a pressing member and a resilient member. The two clamping panels are respectively formed with two circular holes opposite to each other. The rotary member is rotatably disposed in the circular holes. A middle portion of an outer periphery of rotary member is formed with multiple teeth. Two end portions of the outer periphery are two fitting sections for fitting into the holes of the two clamping panels. One of the fitting sections is formed with a through hole in which the pressing member and the resilient member are disposed. The inner wall face of the circular hole of the clamping panel serves to stop the pressing member and the resilient member from dropping out. Therefore, the pressing member can be pressed against a nut or a socket to facilitate operation. Also, the structure is simple, easy to be assembled and firmly engaged.

4 Claims, 6 Drawing Sheets

RATCHET WRENCH

BACKGROUND OF THE INVENTION

The present invention relates to a ratchet wrench in which the pressing member and the resilient member are stopped by the clamping panel of the ratchet wrench itself from dropping out.

FIGS. 9 and 10 show a conventional ratchet wrench composed of a grip 9, two clamping panels 92, a rotary member 93, two engaging members 96 and a pressing member 98. A front end of the grip 9 is formed with a hole 91 in which the rotary member 93 is installed. One end of the engaging member 96 is pivotally connected with the grip 9, while the other end of the engaging member 96 is engaged with the rotary member 93. By means of the two engaging members 96, the rotary member 93 can be clockwisely or counterclockwisely rotated.

The rotary member 93 has a toothed section 94 formed with a through hole 95 in which the pressing member 98 is disposed. The pressing member 98 includes a cap member 981, a compression spring 982 and a plug member 983. The compression spring 982 is positioned between the cap member 981 and the plug member 983. One end of the cap member 981 projects from an inner side 931 of the rotary member 93.

According to the above arrangement, the plug member 983 is used to block the spring 982 and prevent the pressing member 98 from dropping out of the through hole 95. Moreover, the front end of the engaging member 96 must be formed with a cut 97 for avoiding the plug member 983 of the pressing member 98. Therefore, it is troublesome to manufacture the ratchet wrench and it is difficult to assemble the pressing member 98. As a result, the cost for the ratchet wrench can be hardly reduced.

SUMMARY OF THE INVENTION

It is therefore a primary object of the present invention to provide a ratchet wrench in which the pressing member and the resilient member are stopped by the clamping panel of the ratchet wrench itself from dropping out. Therefore, the pressing member can be pressed against a nut or a socket to facilitate operation. The ratchet wrench has less components and can be easily manufactured and reliably assembled.

The present invention can be best understood through the following description and accompanying drawings, wherein:

DETAILED DESCRIPTION OF THE PREFERRED EMBODIMENTS

Figure 1:
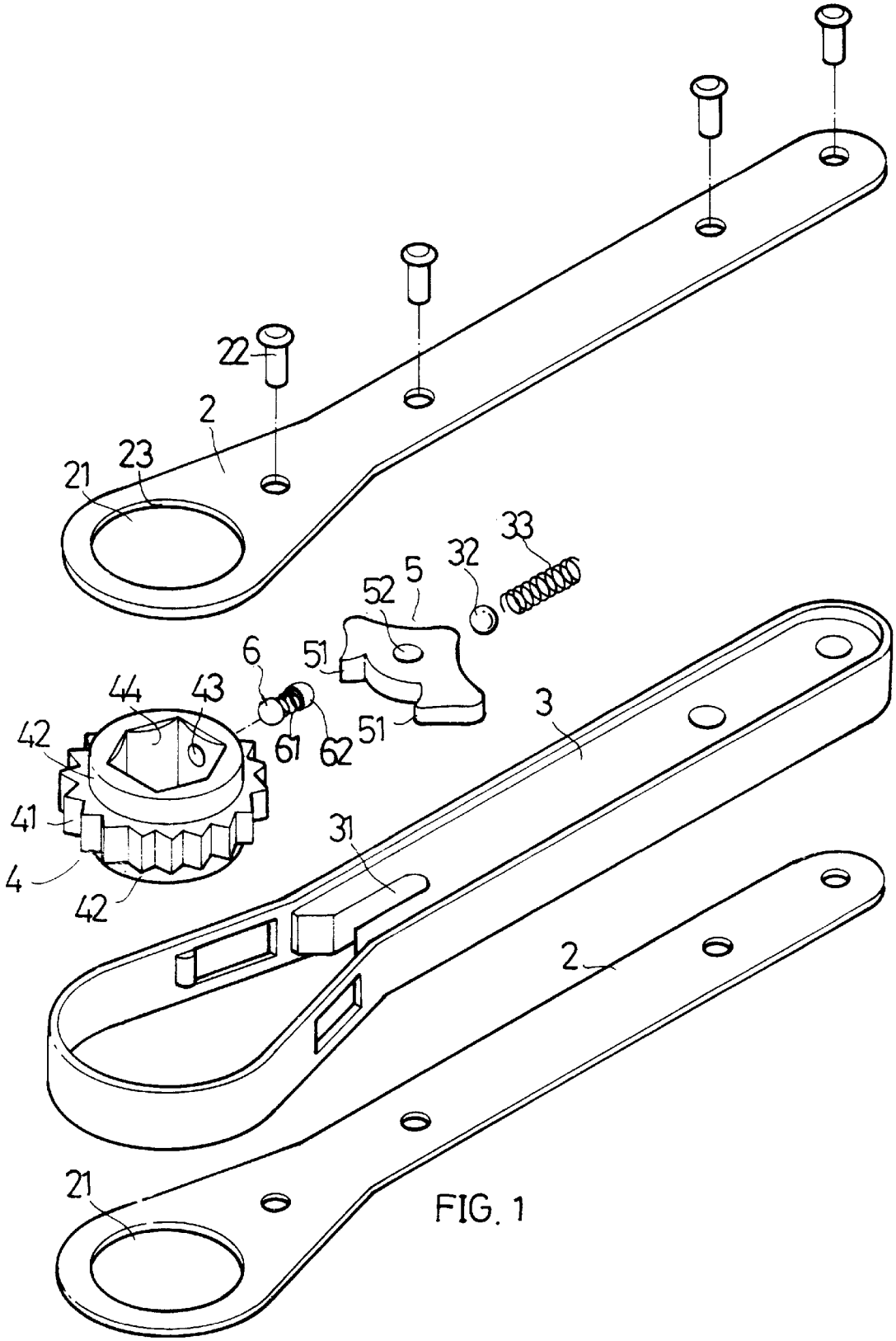
FIG. 1 is a perspective exploded view of a first embodiment of the present invention.
Figure 2:
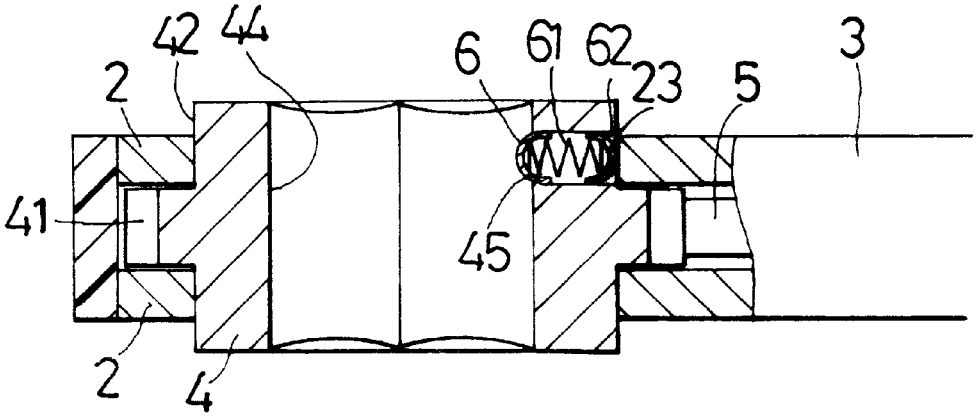
FIG. 2 is a sectional view showing the operation of the first embodiment of the present invention in one state.
Figure 3:
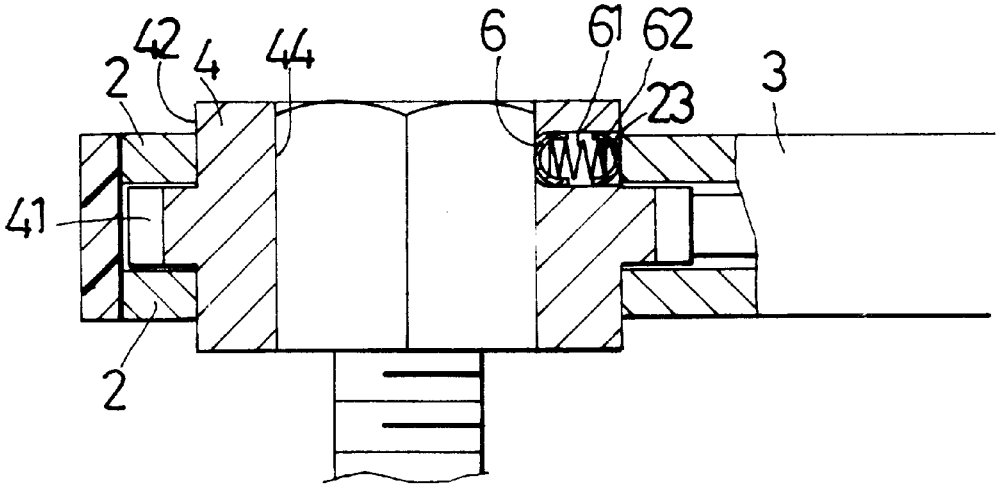
FIG. 3 is a sectional view showing the operation of the first embodiment of the present invention in another state.

Please refer to FIGS. 1 to 3. According to a first embodiment, the ratchet wrench of the present invention includes two clamping panels 2, a base seat 3, a rotary member 4, an engaging member 5, a pressing member 6 and a resilient member 61. The two clamping panels 2 are respectively formed with two circular holes 21 opposite to each other. One end of the base seat 3 is formed with a notch 31 in which a stopper member 32 is disposed. The stopper member 32 is forced by a spring 33 to abut against the engaging member 5. The engaging member 5 has two engaging sections 51 and a hole 52. A pin member 22 is passed through the hole 52 to pivotally connect the two clamping panels 2 with each other. The engaging sections 51 serve to engage with the rotary member 4 and make the same clockwisely or counterclockwisely rotate. The rotary member 4 is a cylindrical body formed with a hexagonal hole. A middle portion of the outer periphery of rotary member 4 is formed with multiple teeth 41. Two end portions of the outer periphery are two fitting sections 42 for fitting into the holes 21 of the two clamping panels 2. One of the fitting sections 42 is formed with a through hole 43 having a relatively small diameter stopper section 45 on inner side of the rotary member 4. The pressing member 6 is disposed in the through hole 43. An inner end of the pressing member 6 has a relatively small diameter. In this embodiment, the pressing member 6 is a cap member having a relatively small diameter close end. The pressing member 6 is pushed by the resilient member 61, whereby the small diameter section of the pressing member 6 projects outside the inner side 44 of the rotary member 4. The stopper section 45 prevents the pressing member 6 from dropping out of the through hole 43 of the rotary member 4. In this embodiment, the resilient member 61 is a compression spring. An outer end of the resilient member 61 is fitted with a cap member 62 identical to the pressing member 6 in structure. After the rotary member 4 is assembled with the clamping panels 2, the through hole 43 of the fitting section 42 is blocked by the inner wall face 23 of the hole 21 of the clamping panel 2. Therefore, the outer cap member 62 is stopped by the inner wall face 23 of the hole 21 of the clamping panel 2 to prevent the pressing member 6 from dropping outside.

Figure 4:
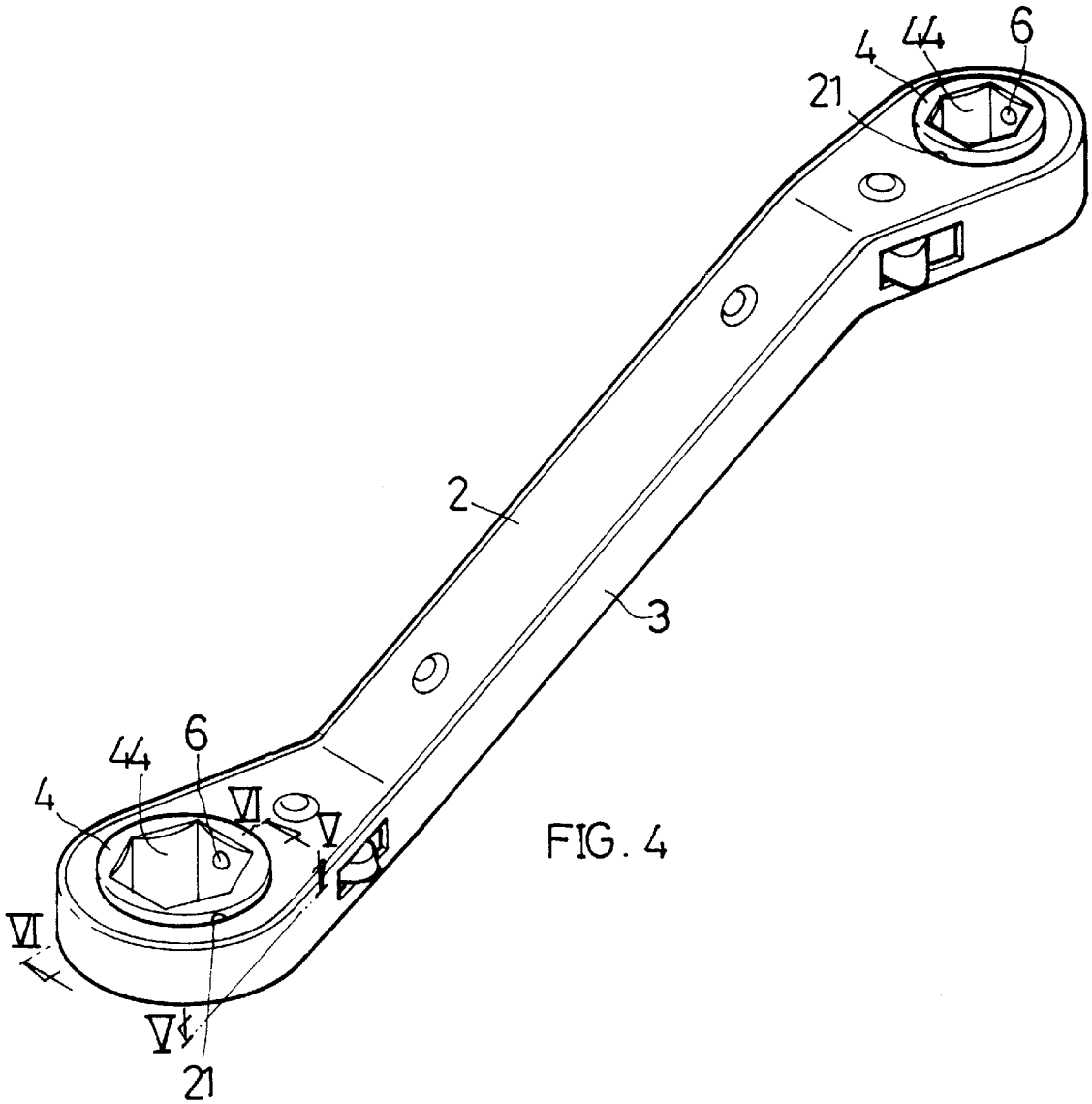
FIG. 4 is a perspective assembled view of a second embodiment of the present invention.
Figure 5:
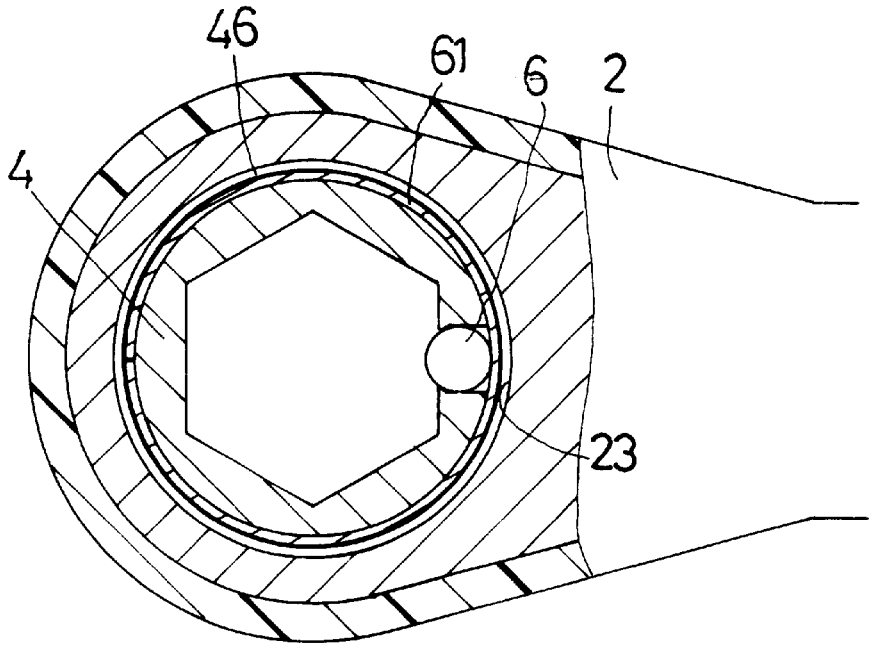
FIG. 5 is a sectional view taken along line V—V of FIG. 4.
Figure 6:
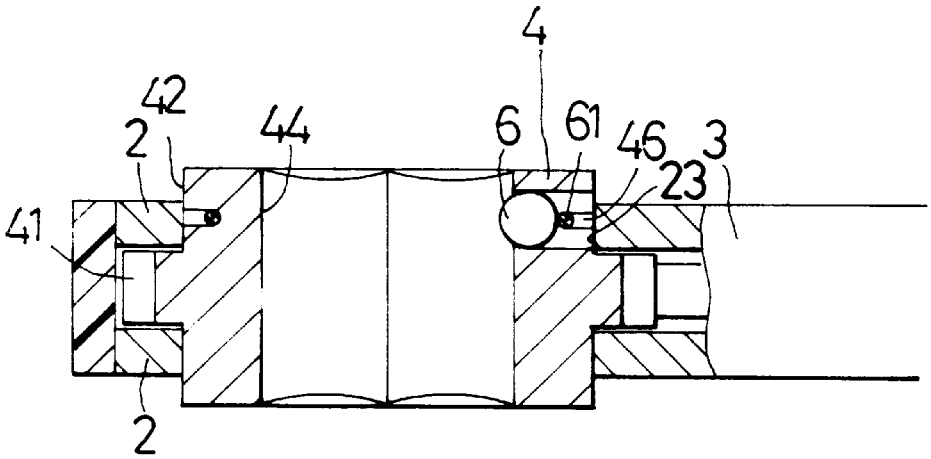
FIG. 6 is a sectional view taken along line VI—VI of FIG. 4.

FIGS. 4 to 6 show a second embodiment of the pressing member 6 of the present invention. Each end of the clamping panels 2 is formed with a circular hole 21 in which a rotary member 4 is rotatably disposed. In this embodiment, the pressing member 6 is a steel ball 63 pushed by a C-shaped resilient member 61*c* made of a metal wire. The C-shaped resilient member 61*c* is positioned in an annular groove 46 of the fitting section 42. The annular groove 46 intersects the through hole 43 of the fitting section 42, whereby the resilient member 61 is stopped by the inner wall face 23 of the hole 21 of the clamping panel 2 from dropping out. This embodiment is advantageous in that the assembling procedure can be easily performed and the possibility of failure is low.

Figure 7:
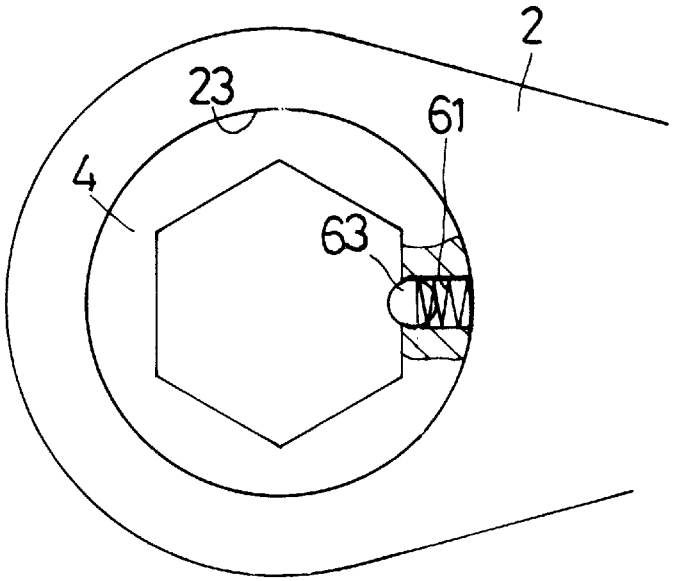
FIG. 7 is a sectional view of a third embodiment of the present invention.

FIG. 7 shows a third embodiment of the pressing member 6 of the present invention, in which the pressing member 6 is a steel ball 63 pushed by a resilient member 61 which is a compression spring. This embodiment has simple components and is manufactured at low cost and can be easily assembled.

Figure 8:
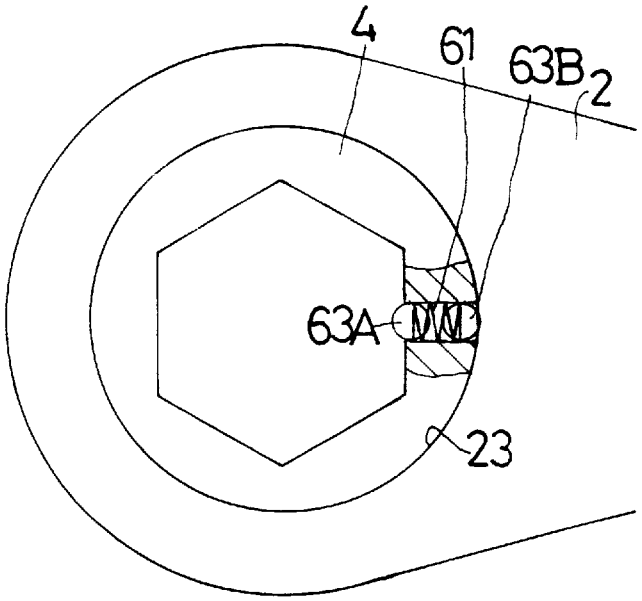
FIG. 8 is a sectional view of a fourth embodiment of the present invention.
Figure 9:
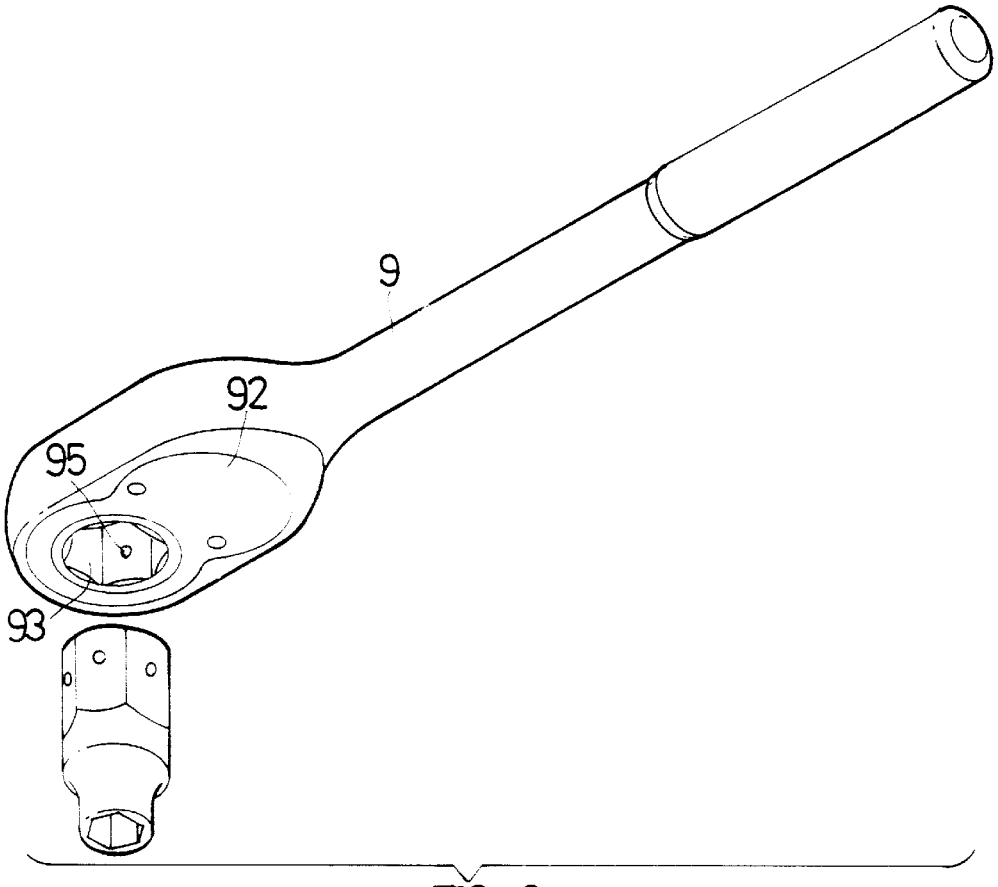
FIG. 9 PRIOR ART
FIG. 9 is a perspective assembled view of a conventional ratchet wrench.
Figure 10:
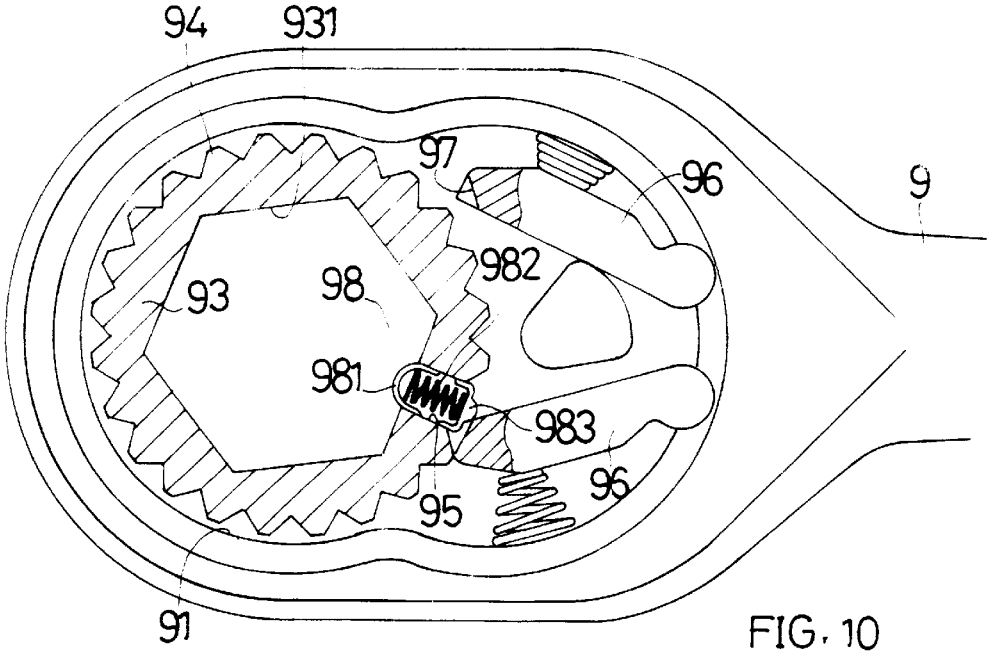
FIG. 10 PRIOR ART
FIG. 10 is a sectional view of the conventional ratchet wrench.

FIG. 8 shows a fourth embodiment of the present invention, in which the pressing member 6 is also a steel ball 63A pushed by a resilient member 61 identical to that of FIG. 7. Another steel ball 63B is disposed at an outer end of the resilient member 61. By means of the steel ball 63B, the frictional force between the resilient member 61 and the inner wall face 23 of the hole 21 of the clamping panel 2 is reduced.

According to the above arrangement, the present invention has less components and is manufactured at low cost. The pressing member 6 is stopped by the clamping panel 2 of the ratchet wrench itself from dropping out, so that the pressing member 6 can be pressed against a nut or a socket to facilitate operation.

It is to be understood that the above description and drawings are only used for illustrating some embodiments of the present invention, not intended to limit the scope thereof. Any variation and derivation from the above description and drawings should be included in the scope of the present invention.

What is claimed is:

1. A ratchet wrench comprising:

two clamping panels, a base seat disposed between the two clamping panels, a rotary member, an engaging member, a pressing member and a resilient member, the two clamping panels being respectively formed with two circular holes in aligned relationship with each other, one end of the base seat being formed with a notch in which a stopper member is disposed, the stopper member being biased to abut against the engaging member, the engaging member having two engaging sections and a hole, a pin member being passed through the hole and corresponding openings in the two clamping panels to pivotally connect the engaging member to the two clamping panels, the engaging sections serving to engage with the rotary member to prevent clockwise or counterclockwise rotation thereof, the rotary member being a cylindrical body formed with a hexagonal hole, the rotary member having an outer periphery with two end portions defining fitting sections for respectively fitting into the circular holes of the two clamping panels and a middle portion therebetween, the middle portion being formed with multiple teeth, one of the fitting sections being formed with a through hole having a relatively small diameter stopper section at a first end of the through hole adjacent an inner side of the rotary member, the pressing member being disposed in the through hole and being biased by a resilient member, whereby a relatively small diameter section of the pressing member projects outwardly from the inner side of the rotary member through hole, the stopper section preventing the pressing member from dropping out of the through hole of the rotary member, the through hole of the fitting section having a second end blocked by a respective inner wall face of the circular hole of a corresponding clamping panel for retaining the resilient member and the pressing member within the through hole.

2. The ratchet wrench as claimed in claim 1, wherein the pressing member is a first cap member having a relatively small diameter closed end and the resilient member is a compression spring, an outer end of the compression spring being fitted with a second cap member having an identical structure and shape as the first cap member.

3. The ratchet wrench as claimed in claim 1, wherein the pressing member is a steel ball biased by a C-shaped resilient member made of a metal wire, the C-shaped resilient member being positioned in an annular groove formed in the fitting section, the annular groove intersecting the through hole of the fitting section.

4. The ratchet wrench as claimed in claim 1, wherein the pressing member is a first steel ball biased by a first end of the resilient member, a second steel ball being disposed at a second end of the resilient member, the second steel ball contacting the inner wall face of the circular hole.

* * * * *